US005915730A

United States Patent [19]

Petkovsek

[11] Patent Number: 5,915,730

[45] Date of Patent: Jun. 29, 1999

[54] SPECIAL SERVICE MAILING ASSEMBLY WITH RECEIPT AND LABEL AND A METHOD FOR PREPARING A MAILPIECE FOR DELIVERY

[76] Inventor: Glenn Petkovsek, 2 Saverne Cir., Little Rock, Ark. 72211

[21] Appl. No.: 08/878,046

[22] Filed: Jun. 18, 1997

[51] Int. Cl.[6] ..... B42D 15/00

[52] U.S. Cl. ..... 283/79; 283/81; 283/101; 283/103; 283/61; 283/62; 281/2; 281/5; 462/26; 462/8

[58] Field of Search ..... 283/79, 81, 101, 283/103, 56, 61, 62, 116, 117; 462/6, 26, 64, 65, 8; 281/2, 5; 229/300, 92.8, 70, 68.1, 314, 315; 40/630, 638

[56] References Cited

U.S. PATENT DOCUMENTS

| | | | |
|---|---|---|---|
| 4,418,865 | 12/1983 | Bowen . | |
| 4,491,334 | 1/1985 | Dicker . | |
| 4,565,317 | 1/1986 | Kranz . | |
| 4,682,793 | 7/1987 | Walz . | |
| 5,183,203 | 2/1993 | Sanders . | |
| 5,190,210 | 3/1993 | Walz . | |
| 5,325,303 | 6/1994 | Walz et al. . | |
| 5,397,052 | 3/1995 | Walz | 229/92.8 |
| 5,476,420 | 12/1995 | Manning . | |
| 5,501,393 | 3/1996 | Walz | 229/92.8 |
| 5,507,526 | 4/1996 | Petkovsek . | |
| 5,573,277 | 11/1996 | Petkovsek | 283/79 |
| 5,626,286 | 5/1997 | Petkovsek | 229/300 |
| 5,626,370 | 5/1997 | Petkovsek | 283/116 |
| 5,664,725 | 9/1997 | Walz | 229/92.8 X |
| 5,697,648 | 12/1997 | Petkovsek | 283/61 |
| 5,746,450 | 5/1998 | Petkovsek | 283/61 |
| 5,776,571 | 7/1998 | Michlin et al. | 283/81 X |

*Primary Examiner*—Frances Han
*Attorney, Agent, or Firm*—Patents & TMS, P.C.; Brian M. Mattson

[57] ABSTRACT

A mailing assembly for use in connection with non-domestic delivery of a mailpiece wherein the sender of the mailpiece is required to complete a sender's declaration. The assembly includes a mailing label, a receipt card and a backing sheet. The mailing label and receipt card are detachably connected to each other and form the entirety of the complete mailing form. Such form is, in turn, adhesively connected to the backing sheet having approximately the same size and shape as the form. An adhesive layer is only provided between the mailing label and the backing sheet and not between the receipt card and the backing sheet. The sender provides all the necessary information on the mailing label relating to the contents of the mailpiece being delivered. The sender also completes the receipt card which serves as a declaration in compliance with U.S. Customs' requirements. Upon completion, the receipt card is detached from the mailing label and retained by the U.S. Postal Service for recording purposes. At the same time, the mailing label is peeled away from the associated backing sheet and placed upon the mailpiece in preparation for delivery.

18 Claims, 2 Drawing Sheets

SPECIAL SERVICE MAILING ASSEMBLY WITH RECEIPT AND LABEL AND A METHOD FOR PREPARING A MAILPIECE FOR DELIVERY

BACKGROUND OF THE INVENTION

The present invention generally relates to a form for printing mailpiece information relating to mail handling for attachment to a mailpiece. More specifically, the present invention relates to a multi-part form including a mailing label and detachable receipt card for non-domestic delivery of a mailpiece.

It is, of course, known to provide specialized postal processing and handling of particular mailpieces requiring delivery via Foreign Airmail. Such special services include the preparation of specialized customs/postal forms which certify that the sender of the mailpiece is complying with U.S. Customs requirements with regard to the mailing of the mailpiece.

Traditionally, PS Form 2976 has been used on those packages for Foreign Airmail which are substantially flat (i.e., envelopes and folders). Conversely, PS Form 2976-A has been used for larger, box-type packages. PS Form 2976 is a simple label which may be affixed directly to the outside of the appropriate mailpiece. On this form, the sender of the mailpiece must indicate the weight, value and description of the contents of the mailpiece. PS Form 2976 does not, however, require either a sender's signature or sender's declaration attesting to the contents of the mailpiece. Should the envelope or folder which is being mailed contain any merchandise or merchandise samples, the sender may be required to complete a separate Parcel Post Customs Declaration Form 2966-A which is then retained by the U.S. Postal Service.

PS Form 2976-A is a quadruplicate mailing form which incorporates a customs declaration. This form also requires that a signature be received from the addressee upon delivery of the mailpiece. Once imprinted with the necessary information, PS Form 2976-A is inserted into a see-through mailing envelope which is, in turn, affixed to the mailpiece for delivery.

However, due to recent changes in U.S. Postal regulations, if a package weighing 16 ounces or greater is to be sent via Foreign Airmail, the sender of the package must complete a sender's declaration. Accordingly, many envelopes and folders which previously only required the affixation of PS Form 2976 now also require that a separate Form 2966-A be completed (Customs Declaration).

Given the tremendous increase in the number of Foreign Airmail packages which now require the completion of both a mailing label and a Customs Declaration, there is an increased need for an improved multi-purpose Foreign Airmail mailing form which includes both a mailing label and a sender's declaration and which can be prepared in the most efficient way possible.

SUMMARY OF THE INVENTION

The present invention provides a mailing form for the non-domestic delivery of a mailpiece, particularly envelopes and folders, wherein the form includes both a mailing label and a detachable sender's declaration. In addition, the present invention provides a method for preparing a mailpiece for non-domestic delivery wherein a mailing label is affixed to the mailpiece and a corresponding sender's declaration is retained by the U.S. Postal Service.

To this end, in an embodiment of the present invention, a mailing assembly for use in connection with the non-domestic delivery of a mailpiece is provided which includes a backing sheet and a mailing form which is removably attached to the backing sheet. The form may be variably printed with information necessary to comply with postal requirements for non-domestic delivery of the mailpiece.

In an embodiment, an adhesive layer is disposed between the form and the backing sheet.

In an embodiment, the form of the assembly includes a sender information section as well as an addressee information section.

In an embodiment, the form of the assembly also includes machine-readable information which is associated with the particular mailpiece.

In an embodiment, a mailing label forms a portion of the form and a receipt card which is connected to the mailing label forms the remainder of the form.

In an embodiment, an adhesive layer is disposed only between the mailing label and the backing sheet.

In an embodiment, the receipt card is detachable from the label on the form.

In another embodiment of the present invention, a mailing assembly is provided which includes a first backing sheet and a first mailing form which is removably attached to the first backing sheet. The first mailing form also includes a first mailing label and a first receipt card which is detachably connected to the first mailing label. A tear line separates the first mailing label from the first receipt card. In addition, the first mailing label may be variably printed with information which is unique to the first mailpiece. A first adhesive layer is also provided between the first mailing label and the first backing sheet.

In an embodiment, the first mailing form of the assembly also includes a first sender information section and a first addressee information section.

In an embodiment, the assembly includes a first machine-readable code section containing machine readable information associated with the first mailpiece.

In an embodiment, the assembly includes a second backing sheet detachably connected to the first backing sheet and a second mailing form removably attached to the second backing sheet and detachably connected to the first mailing form. The second mailing form includes a second mailing label which may be variably printed with information which is unique to a second mailpiece. The second mailing form further includes a second receipt card detachably connected to the second mailing label wherein a second tear line separates the second mailing label from the second receipt card. A second adhesive layer is also included in this embodiment between the second mailing label on the second backing sheet.

In an embodiment, the second mailing form of the assembly includes a second sender information section and a second addressee information section.

In an embodiment, the assembly includes a second machine-readable code section containing machine-readable information associated with the second mailpiece.

In yet another embodiment of the present invention, a method is provided for preparing a mailpiece for non-domestic delivery. The method includes the steps of: providing a mailing form which is removably attached to a backing sheet; printing variable information on the form which complies with non-domestic delivery requirements; and attaching the form to the mailpiece.

In an embodiment, the method further includes the step of: providing an adhesive layer between the form and the backing sheet.

In an embodiment, the method further includes the steps of: entering sender information on the form; and entering addressee information on the form.

In an embodiment, the method further includes the step of: imprinting a machine-readable code on the form.

In an embodiment, the method further includes the steps of: providing a mailing label on the form; and providing a receipt card on the form which is detachably connected to the label.

In an embodiment, the method further includes the step of: providing an adhesive layer only between the mailing label and the backing sheet.

In an embodiment, the method further includes the step of: detaching the receipt card from the label.

It is, therefore, an advantage of the present invention to provide an improved mailing assembly for use in connection with the non-domestic delivery of a mailpiece.

Another advantage of the present invention is to provide an assembly and a method for use in connection with the non-domestic delivery of a mailpiece without requiring additional adhesives or fixatives for attaching the same to a mailpiece.

Yet another advantage of the present invention is to provide an assembly which includes both a mailing label and a sender's declaration which may be used in connection with the non-domestic delivery of a mailpiece; particularly, envelopes and folders.

Moreover, an advantage of the present invention is to provide a mailing assembly for use in connection with the non-domestic delivery of a mailpiece which may be thermally imprinted with information.

Another advantage of the present invention is to provide an assembly and method for use in connection with the non-domestic delivery of a mailpiece which allows the sender to complete but a single form.

A further advantage of the present invention is to provide a simplified assembly and method for use in connection with the non-domestic delivery of a mailpiece.

Additionally, it is an advantage of the present invention to provide an assembly for use in connection with the non-domestic delivery of a mailpiece which is practical and economical.

DETAILED DESCRIPTION OF THE PRESENTLY PREFERRED EMBODIMENTS

Figure 1:
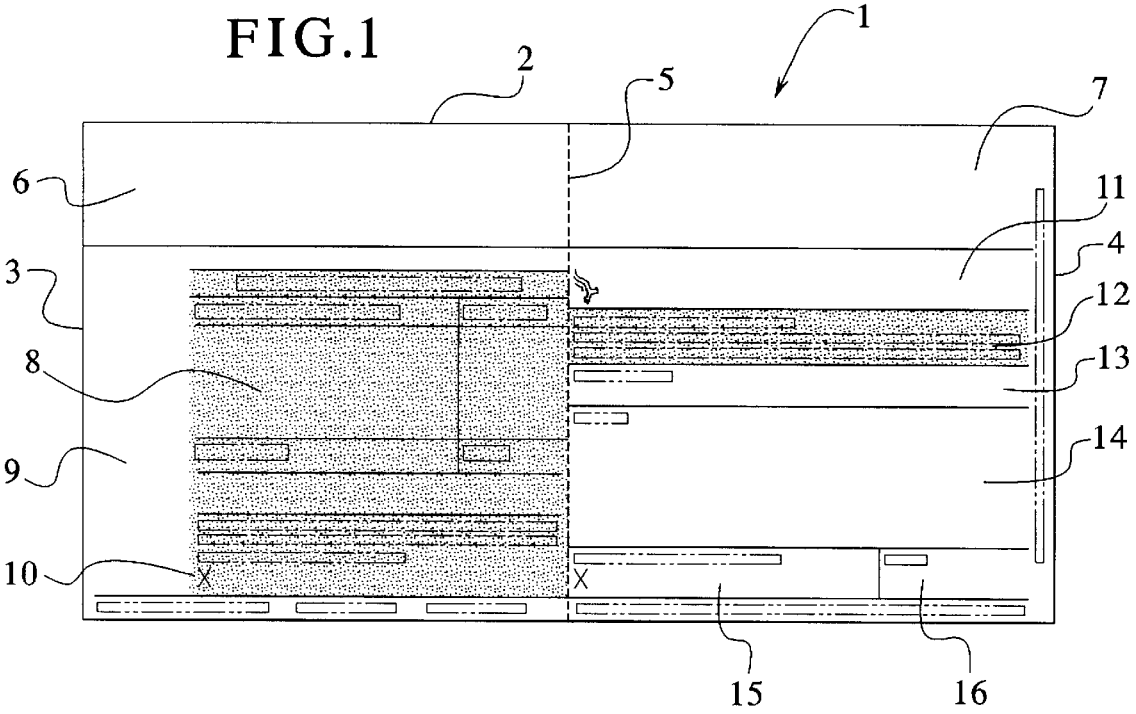
FIG. 1 illustrates a plan view of a front side of an embodiment of the mailing assembly of the present invention.

Referring now to the drawings, wherein like numerals refer to like parts, FIG. 1 is a front-plan view that generally illustrates an embodiment of a mailing assembly 1 formed, in part, from a mailing form 2. The mailing form 2 has a mailing label 3 and a receipt card 4; the mailing label 3 and the receipt card 4 are detachably connected along a mailing form tear line 5.

Among other things, the mailing label 3 includes the type of information traditionally found on PS Form 2976. Indeed, the mailing label 3 includes a mailpiece information area 8 which requires the disclosure of the contents of the mailpiece, the weight of the mailpiece and the estimated value of the contents of the mailpiece. In addition, the mailing label 3 includes a label tracking area 9 capable of being variably printed with information necessary to track the associated mailpiece. Furthermore, the mailing label 3 includes a label signature area 10 for receipt of the signature of the sender (or agent) of the mailpiece.

The embodiment shown in FIG. 1 further includes an auxiliary information area 6 on the mailing label 3 which is capable of being imprinted with variable information relating to the non-domestic delivery of the associated mailpiece. For instance, if delivery of the mailpiece is exempt from U.S. Customs' requirements because the mailpiece has a military purpose, the auxiliary information area 6 might be imprinted with the words "Contents for Official Use, Exempt from Customs' Requirements-Military Service."

Detachably connected to the mailing label 3 via the mailing form tear line 5 is the receipt card 4. Functionally, the receipt card 4 serves the same purpose as the altogether separate Form 2966-A, Parcel Post Customs Declaration. Thus, the receipt card 4 includes a receipt card tracking area 11 capable of being variably printed with information similar, if not identical, to that which is imprinted in the label tracking area 9 of the mailing label 3.

Also included on the receipt card 4 is a declaration area 12 which is imprinted with a standard declaration statement to which the sender of the mailpiece attests. Sender information area 13 of the receipt card may include the name of the sender of the mailpiece while sender address area 14 may include the address of the sender. Receipt card signature area 15, much like the label signature area 10, may be included for the signature of the sender (or agent) of the mailpiece. At the same time, the sender of the mailpiece enters the appropriate date in a date area 16. The receipt card 4 is preferably provided with a second auxiliary information area 7 intended to be variably imprinted with such optional information as that found, and previously described, in the auxiliary information area 6 of the mailing label 3.

Figure 2:
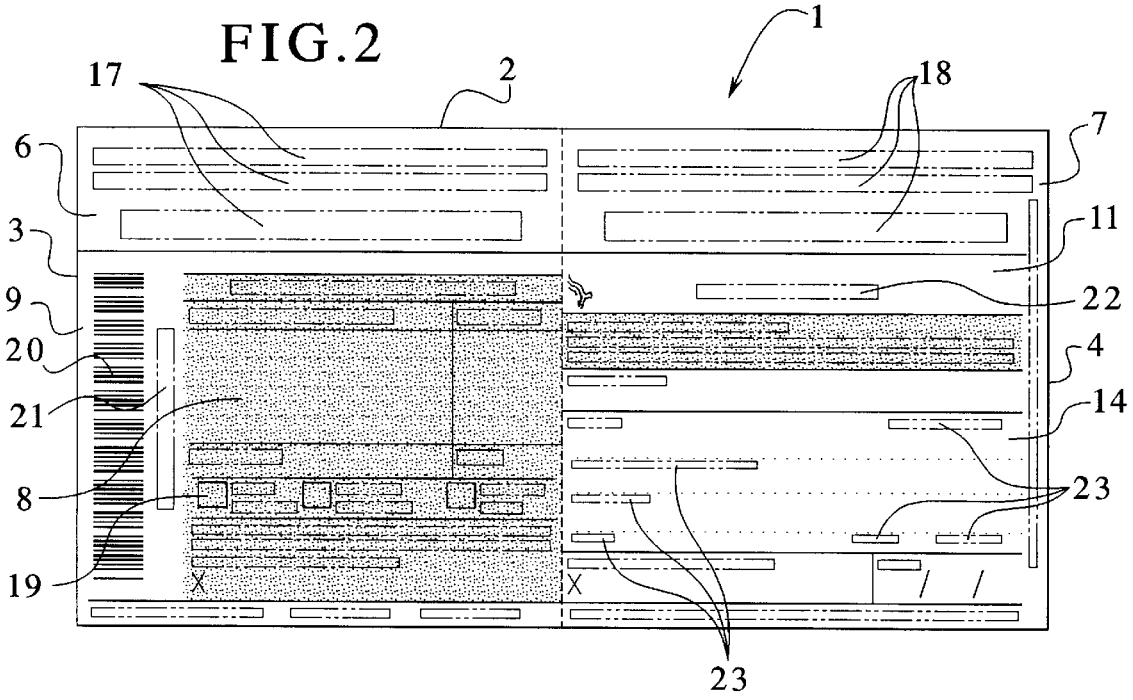
FIG. 2 illustrates a plan view of a front side of an embodiment of the mailing assembly of the present invention having variable information imprinted thereon.

FIG. 2 offers a front view of the embodiment of the mailing assembly 1 from FIG. 1 complete with a variety of variably printed information thereon. Indeed, one of the key advantages of the present invention is that the mailing assembly 1 may be imprinted with such variable information through the use of a thermal printer. Such variable information includes, for example, the auxiliary information 17 within the auxiliary information area 6. Again, the present invention contemplates that a variety of auxiliary information 17 may be imprinted within the auxiliary information area 6 as this is merely an optional informative section, something which is not currently found on PS Form 2976. Additional variably printed information may include a bar code 20 and tracking number 21 placed upon the label tracking area 9. This machine-readable information is intended to be compatible with the United States Postal Service's existing track and trace network. Other variably printed information includes the contents information 19 within the mailpiece information area 8 which includes descriptive boxes by which the sender of the mailpiece may generally identify the contents of the mailpiece.

The receipt card 4 of the mailing form 2 may also be imprinted with variable information. The auxiliary information 18 placed within the second auxiliary information area 7 is intended to be the same as the auxiliary information 17 imprinted upon the mailing label 3. Similarly, a tracking number 22 within the receipt card tracking area 11 may be identical to the tracking number 21 imprinted upon the mailing label 3. Lastly, a variety of specific address queries 23 are preferably imprinted within the center address area 14 for clarity and simplicity.

Figure 3:
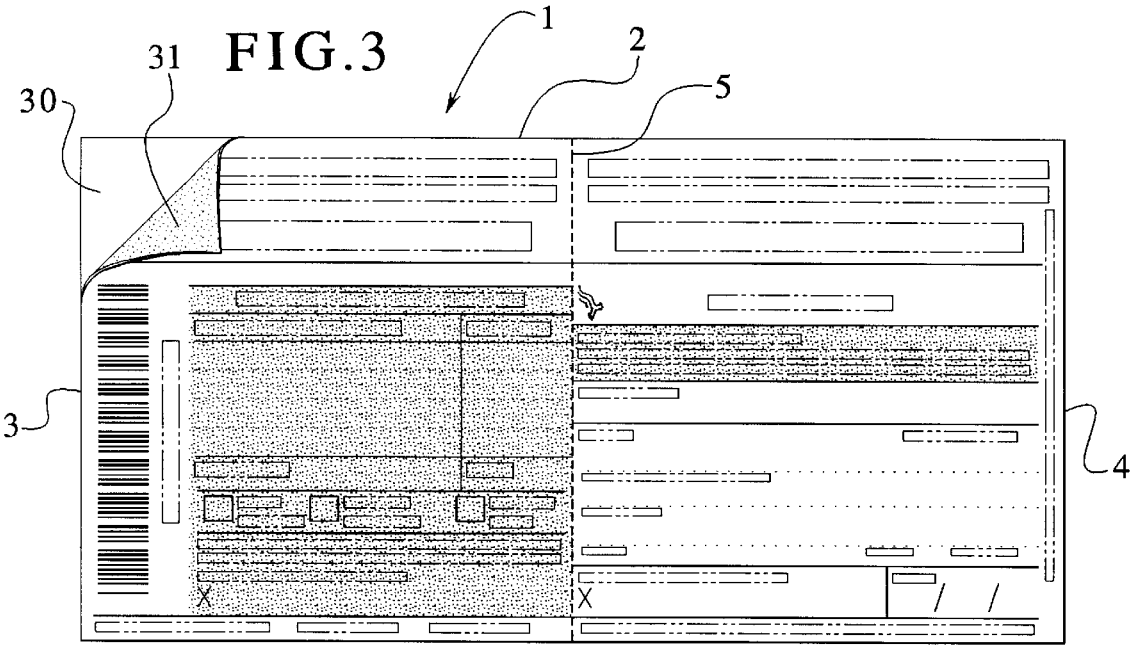
FIG. 3 illustrates a plan view of a front side of an embodiment of the mailing assembly of the present invention with one corner partially peeled away from an associated backing sheet.

Turning now to FIG. 3, the complete mailing assembly 1 from FIG. 2 is shown whereby an upper left-hand corner of the mailing label 3 is partially peeled away from an associated backing sheet 30. Each mailing assembly 1 has a backing sheet 30 which is approximately the same size and shape as the mailing form 2 which is affixed thereupon. Only the mailing label 3 of the mailing form 2, however, is provided with an adhesive layer 31 for detachable adhesion to the backing sheet 30. That is, there is no adhesive layer between the receipt card 4 of the mailing form 2 and the backing sheet 30. Again, the dividing line between the mailing label 3 and the receipt card 4 is defined by the mailing form tear line 5. The adhesive layer 31 serves the dual purpose of initially securing the mailing form 2 to the backing sheet 30 and, after the mailing label 3 is peeled away from the backing sheet 30, of subsequently permanently affixing the mailing label 3 to the desired mailpiece. It should be noted that the receipt card 4 is typically detached from the mailing label 3 prior to the mailing label 3 being permanently affixed to the desired mailpiece.

Indeed, in keeping with current U.S. Postal Customs' requirements, the receipt card 4 may be detached from the mailing label 3 and retained by the U.S. Postal Service immediately after the entire mailing form 2 is filled out by the sender of the mailpiece and presented to a U.S. Postal employee. Thereafter, that mailing label 3 may be peeled away from the backing sheet 30 and immediately placed upon the mailpiece for delivery.

Figure 4:
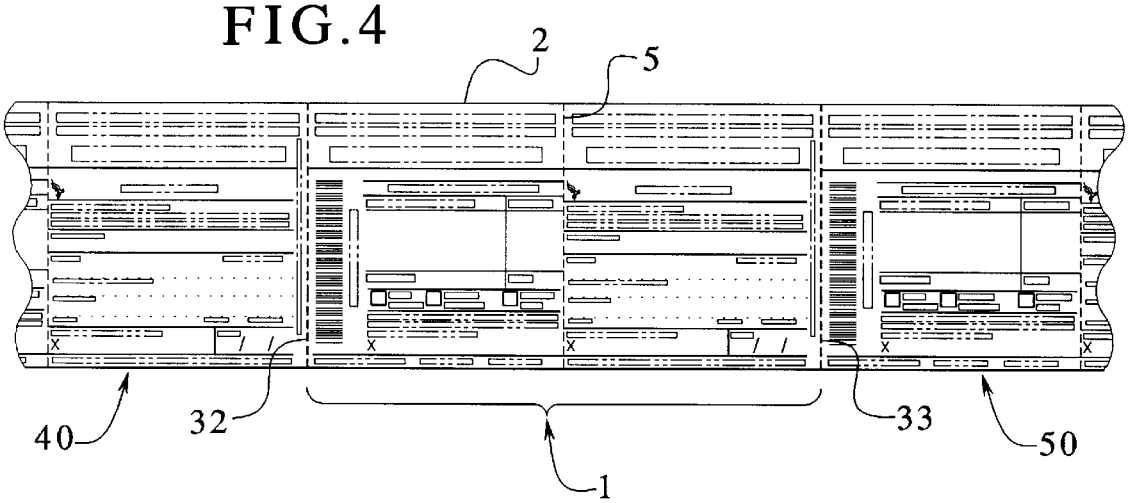
FIG. 4 illustrates a plan view of front sides of a plurality of mailing assemblies of the present invention detachably connected in end-to-end fashion.

FIG. 4 shows another embodiment of the present invention whereby a number of mailing assemblies are continuously and detachably interconnected (end-to-end, for example) such that the mailing assemblies may be provided on a reel or roll. Such reel or roll may be provided for use with, for example, some form of dispensing device. As shown in FIG. 4, the mailing assembly 1 is connected on one of its edges to a second mailing assembly 40 and on the other of its edges to a third mailing assembly 50. The mailing assembly 1 is detachably connected to the second mailing assembly 40 via a first mailing assembly tear line 32 and is detachably connected to the third mailing assembly 50 via a second mailing assembly tear line 33. The mailing assembly tear lines 32 and 33 are perforations which go all the way through to, and may include, the associated backing sheets. Conversely, the mailing form tear line 5 perforates only the mailing form 2 and not the associated backing sheet 30.

Figure 5:
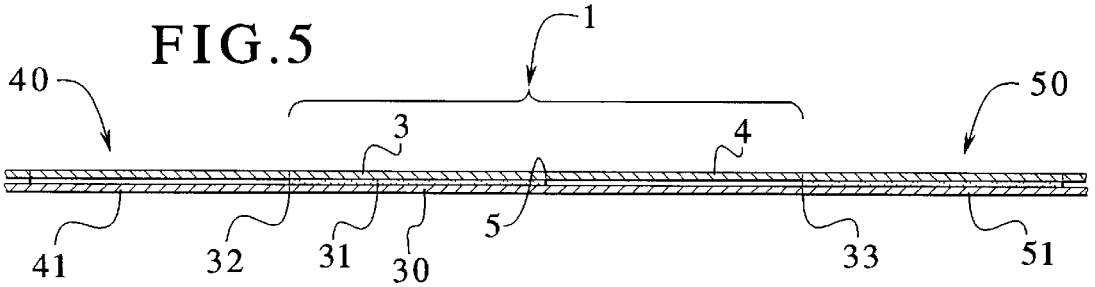
FIG. 5 illustrates a bottom-end view of the embodiments of the mailing assemblies shown in FIG. 4.

Looking now at FIG. 5, a bottom edge of the mailing assemblies from FIG. 4 is shown. Here it may be more clearly observed that the adhesive layer 31 of the mailing assembly 1 is disposed only between the mailing label 3 and the backing sheet 30 and not between the receipt card 4 and the backing sheet 30. Such is the case for all similar mailing assemblies 40, 50, etc. Also, as described in connection with FIG. 4, the first mailing assembly tear line 32 may perforate the entirety of both the mailing assembly 1 and the mailing assembly 40 including their respective backing sheets 30 and 41. Similarly, the second mailing assembly tear line 33 may perforate both the backing sheet 30 and the third backing sheet 51. Conversely, the mailing form tear line 5 of the mailing assembly 1 does not perforate the associated backing sheet 30 but only the associated mailing label 3 and the receipt card 4. Such design ensures that individual mailing assemblies which are provided on a reel or roll may be individually detached from the remaining mailing assemblies with relative ease and without fear of accidental separation of a mailing label from its associated receipt card.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A mailing assembly for use in connection with non-domestic delivery of a mailpiece holding contents for delivery thereof, the assembly comprising:

a backing sheet; and a mailing form removably attached to the backing sheet, the form variably printed with information necessary to comply with requirements for delivery of the mailpiece including data concerning the contents of the mailpiece wherein a mailing label forms a portion of the form and a receipt card is connected to the label forming a remainder of the form wherein the mailing label and the receipt card are attached substantially equally sized and separable by a tear line between the mailing label and the receipt card.

2. The mailing assembly of claim 1 further comprising:

an adhesive layer between the form and the backing sheet.

3. The mailing assembly of claim 1 further comprising:

a sender information section on the form; and an addressee information section on the form.

4. The mailing assembly of claim 1 further comprising:

a machine-readable code section on the form including machine-readable information associated with the mailpiece.

5. The mailing assembly of claim 1 further comprising:

an adhesive layer provided only between the mailing label and the backing sheet.

6. The mailing assembly of claim 1 wherein the receipt card is detachable from the label.

7. A mailing assembly comprising:

a first backing sheet; and a first mailing form removably attached to the first backing sheet, the first mailing form having a first mailing label variably printed with information unique to a first mailpiece and further having a first receipt card detachably connected to the first mailing label wherein a first tear line separates the first mailing label and the first receipt card wherein the first mailing label and the first receipt card are substantially equally sized and are the only components of the first mailing form; and a first adhesive layer between the first mailing label and the first backing sheet.

8. The mailing assembly of claim 7 further comprising:

a first sender information section on the first mailing form; and a first addressee information section on the first mailing form.

9. The mailing assembly of claim 7 further comprising:

a first machine-readable code section including machine-readable information associated with the first mailpiece.

10. The mailing assembly of claim 7 further comprising:

a second backing sheet detachably connected to the first backing sheet; and a second mailing form removably attached to the second backing sheet and detachably connected to the first mailing form, the second mailing form having a second mailing label variably printed with information unique to a second mailpiece and further having a second receipt card detachably connected to the second mailing label wherein a second tear line separates the second mailing label and the second receipt card; and a second adhesive layer between the second mailing label and the second backing sheet.

11. The mailing assembly of claim 10 further comprising:

a second sender information section on the second mailing form; and a second addressee information section on the second mailing form.

12. The mailing assembly of claim 10 further comprising:

a second machine-readable code section including machine-readable information associated with the second mailpiece.

13. A method for preparing a mailpiece for non-domestic delivery of the mailpiece wherein the mailpiece has contents for delivery thereof, the method comprising the steps of:

providing a mailing form removably attached to a backing sheet;

providing a mailing label on the form;

providing a receipt card on the form connected to the label wherein the mailing label and the receipt card are substantially equally sized and are the only components of the mailing form;

printing variable information on the form necessary to comply with requirements for delivery of the mailpiece including data relating to the contents of the mailpiece;

removing the form from the backing sheet; and attaching the form to the mailpiece.

14. The method of claim 13 further comprising the step of:

providing an adhesive layer between the form and the backing sheet.

15. The method of claim 13 further comprising the steps of:

entering sender information on the form; and entering addressee information on the form.

16. The method of claim 13 further comprising the step of:

imprinting a machine-readable code on the form associated with the mailpiece.

17. The method of claim 13 further comprising the step of:

providing an adhesive layer only between the mailing label and the backing sheet.

18. The method of claim 13 further comprising the step of:

detaching the receipt card from the label.

* * * * *